US007500582B2

(12) United States Patent
Pritchett et al.

(10) Patent No.: US 7,500,582 B2
(45) Date of Patent: Mar. 10, 2009

(54) DISPENSER PUMPS

(75) Inventors: David John Pritchett, Derbyshire (GB); Brian Robert Law, Leicestershire (GB); Jeffrey William Spencer, Leicestershire (GB)

(73) Assignee: Rieke Packaging Systems Limited, Leicester (GB)

( * ) Notice: Subject to any disclaimer, the term of this patent is extended or adjusted under 35 U.S.C. 154(b) by 275 days.

(21) Appl. No.: 10/490,406

(22) PCT Filed: Sep. 27, 2002

(86) PCT No.: PCT/GB02/04407

§ 371 (c)(1),
(2), (4) Date: Jan. 24, 2005

(87) PCT Pub. No.: WO03/028898

PCT Pub. Date: Apr. 10, 2003

(65) Prior Publication Data

US 2005/0115984 A1 Jun. 2, 2005

(30) Foreign Application Priority Data

Oct. 1, 2001 (GB) ..... 0123537.3

(51) Int. Cl.
*B65D 88/54* (2006.01)

(52) U.S. Cl. ..... 222/321.7; 222/380

(58) Field of Classification Search ..... 222/628, 222/309, 321.7, 321.9, 383.1, 384, 385, 402, 222/490, 95, 380, 387
See application file for complete search history.

(56) References Cited

U.S. PATENT DOCUMENTS

| | | | | |
|---|---|---|---|---|
| 4,515,298 | A * | 5/1985 | Czech | 222/380 |
| 4,728,006 | A * | 3/1988 | Drobish et al. | 222/181.3 |
| 4,749,108 | A * | 6/1988 | Dornsbusch et al. | 222/212 |
| 4,796,786 | A * | 1/1989 | Czech | 222/256 |
| 4,890,773 | A * | 1/1990 | Corsette | 222/380 |
| 4,927,059 | A * | 5/1990 | Fiedler et al. | 222/136 |
| 5,409,146 | A * | 4/1995 | Hazard et al. | 222/321.8 |
| 6,026,993 | A * | 2/2000 | Sperna Weiland | 222/480 |
| 6,279,783 | B1 * | 8/2001 | Brown et al. | 222/185.1 |
| 6,453,940 | B1 * | 9/2002 | Tipton et al. | 137/493.9 |
| 6,460,739 | B1 * | 10/2002 | Norris et al. | 222/380 |
| 2003/0075567 | A1 * | 4/2003 | Santagiuliana | 222/380 |

* cited by examiner

*Primary Examiner*—Lien T Ngo
(74) *Attorney, Agent, or Firm*—Woodard, Emhardt, Moriarty, McNett & Henry LLP

(57) ABSTRACT

A pump dispenser suitable for dispensing toothpaste in which a pump chamber has a resiliently flexible flap outlet valve leading into a discharge passage leading to a discharge nozzle. The discharge nozzle features a closure valve, in the form of a concave wall with radial slits, which opens only under appreciable forward pressure. When released, the closure valve closes and retracts forcibly, giving a clean cut-off of product and a degree of backflow via the large outlet valve area of the flap valve as it closes.

13 Claims, 4 Drawing Sheets

DISPENSER PUMPS

FIELD OF THE INVENTION

This invention has to do with dispenser pumps for dispensing discrete doses of a flowable material from a container on which the pump is fitted. The present proposals have particular relevance to dispenser pumps for use with viscous or pasty materials. They are also relevant when material to be dispensed needs to be protected from contact with air e.g. to prevent drying out or degradation. We particularly envisage that the invention may be embodied in a toothpaste dispenser.

BACKGROUND OF THE INVENTION

In recent years toothpaste dispensers have become widely available in which a relatively large volume of paste is contained in a free standing container, and a piston-and-cylinder dispenser pump with a fixed discharge nozzle is provided at the top of the container to dispense a dose of toothpaste when the pump piston is depressed. Known pumps include arrangements for covering, blocking or shielding the discharge nozzle outlet between operations of the pump to keep the residual paste in the pump from drying out and to help separate the tail end of each dispensed dose from the nozzle end. Toothpaste is extremely sticky and there are often problems in that slugs of paste issuing forth are not cleanly cut off, leading to toothpaste being smeared on the outside of the discharge nozzle by the cover arrangement which is precisely the opposite of what is wanted.

SUMMARY OF THE INVENTION

This application addresses, independently and in combination, various technical aspects of dispenser pumps of the kind described. One particular aspect is a novel arrangement for closing off a discharge nozzle of such a pump. Another aspect is proposals for inlet and outlet valves in such a pump. Any and all of these features may be combined in a dispenser, especially a toothpaste dispenser.

In general terms, a dispenser pump of the relevant kind will have a pump chamber whose volume is alterable in a pumping stroke by relative movement between a body of the pump and a plunger which is reciprocable relative to the body by hand actuation. Typically the plunger has a piston which works in a cylinder of the pump body, the piston and cylinder defining a pump chamber between them. An inlet is provided for flowable material to enter the pump chamber from a container to which the pump is secured, and an outlet of the pump chamber leads to a discharge passage which extends to a discharge nozzle having an external nozzle opening. Usually a one-way inlet valve is provided for the pump chamber, and usually (in some cases, necessarily) a one-way outlet valve.

A first proposal relates to a closure valve at the discharge nozzle opening. We propose the use of a closure comprising resiliently flexible material, providing a wall whose periphery is retained and constrained at the surrounding discharge nozzle structure, the wall having one or more discharge openings closed in a rest condition of the wall, but open when the wall is caused to bulge outwardly under pressure of discharged product from the pump. In particular, we envisage the use of a closure where the wall is outwardly concave, so that under forward fluid pressure it must pass through a peak of compressive strain before reaching a wholly or partially outwardly convex configuration in which the discharge opening opens. Closure valves of this kind are known. They can offer the advantage of a very positive cutting or closure action when pressure is relieved because the sides of the discharge opening(s) are positively pressed together as the wall returns to its rest condition. Also, the axial retraction of the wall as its opening shuts helps to detach adherent material. Typically the discharge opening has one or more slits.

Such closures have previously been used in squeezable containers; this proposal is distinctive in using such a closure at the nozzle of a pump which has its own discrete outlet valve (essentially a one-way valve) upstream of the mentioned resilient closure.

The retraction of such a concave closure wall at the end of discharge calls for some retreat of material still in the discharge passage behind it. Otherwise full closure of the discharge opening(s) may be inhibited.

To improve performance, we therefore propose to use an outlet valve for the pump which will accommodate an appreciable degree of reverse flow after the discharge stroke. We prefer an outlet valve whose movable valve element is a swinging flap, preferably of flexible material and more preferably resiliently flexible material. So that the suck-back need not require a large distance of movement at the pump outlet valve, we prefer that the discharge flow area at the outlet valve be greater than the flow area at the discharge nozzle spanned by the closure wall. A preferred arrangement has the pump outlet valve as an annular flap acting between the pump chamber and an annular outlet chamber which communicates with the discharge channel proper e.g. from one point on its circumference. For a compact construction, the annular outlet valve may be disposed surrounding an inlet to the pump chamber.

Deformable e.g. elastomeric elements for the inlet and outlet valves may be formed together as a one-piece valve entity, with a central formation for the inlet and a peripheral flap for the outlet. This is in itself known, although not in pumps of particular kinds described here.

One embodiment of such a one-piece valve module has the inlet valve formed as a duckbill valve. This is believed to be new as such and is proposed here as an independent invention as well as in combination with other features disclosed here. A duckbill valve has the feature of closing itself resiliently with only a small movement with a one-way action and without requiring separate biasing so that it is particularly suitable for use in thick pasty products such as toothpaste.

A container to which the pump body is secured with its inlet in communication is not particularly limited. However for products such as toothpaste, which suffer from contact with air, a vented container is not preferred. Instead it may have a follower piston as a base, or be a collapsible container which is preferred. In particular, the container may have a thin collapsible wall connected integrally to a thicker securing collar which plugs into or onto a corresponding securing formation of the pump body. A corresponding dispenser apparatus preferably surrounds the collapsible container with a rigid shell or support, which may have any or all of the functions of protecting the collapsible container, disguising the collapsible container and serving as a support stand or hand grip.

A preferred format for a dispenser system, suitable for e.g. toothpaste, provides a lower container shell (which may itself be a container, or may surround a collapsible bag container as mentioned) with a base surface for standing, and a pump module mounted on top of the lower container with a plunger axis of the pump generally upright (it may be inclined, e.g. slightly rearwardly), with a fixed discharge channel extending up alongside the pump chamber from the pump chamber outlet, which is adjacent the bottom of the pump, up to the discharge nozzle which opens generally sideways adjacent the top of the pump. The pump plunger may be pressed directly by hand. More preferably a pivoted lever is provided e.g. in the form of a swinging button cap, which may contact the plunger top so as to give some mechanical advantage in the pumping action.

A further particular feature proposed herein, which may be embodied in dispensers and pump dispensers of other types, is a particular conformation of a collapsible bag from which product is to be dispensed. With collapsible containers measures are needed to prevent uncontrolled collapse of the container leading to bodies of product becoming isolated from the pump inlet by folds of the container wall. One conventional arrangement has a central finned rod extending down into the container from the centre of the pump body, keeping the container longitudinally extended and providing riser channels for the product even when nearly exhausted. This is not easily combined with certain constructions of pump inlet. A proposal here is to provide the wall of the collapsible container with a longitudinally extended preformed corrugation which can to some extent stiffen the wall of the bag longitudinally at one or a few parts of its circumference: other parts may be plain. In the collapsed condition, the corrugation helps to keep open a flow channel to the pump inlet. Additionally or alternatively, the collapsible bag wall may have a longitudinally-graduated wall thickness. Thus, it may be more readily collapsible at its base than nearer the top, encouraging a gradual turning of the bag inside out from the bottom as dispensing proceeds, rather than "waisting" higher up as is otherwise the tendency.

BRIEF DESCRIPTION OF THE DRAWINGS

Examples of our proposals are now described with reference to the accompanying drawings, in which.

DETAILED DESCRIPTION OF PREFERRED EMBODIMENTS

Figure 1:
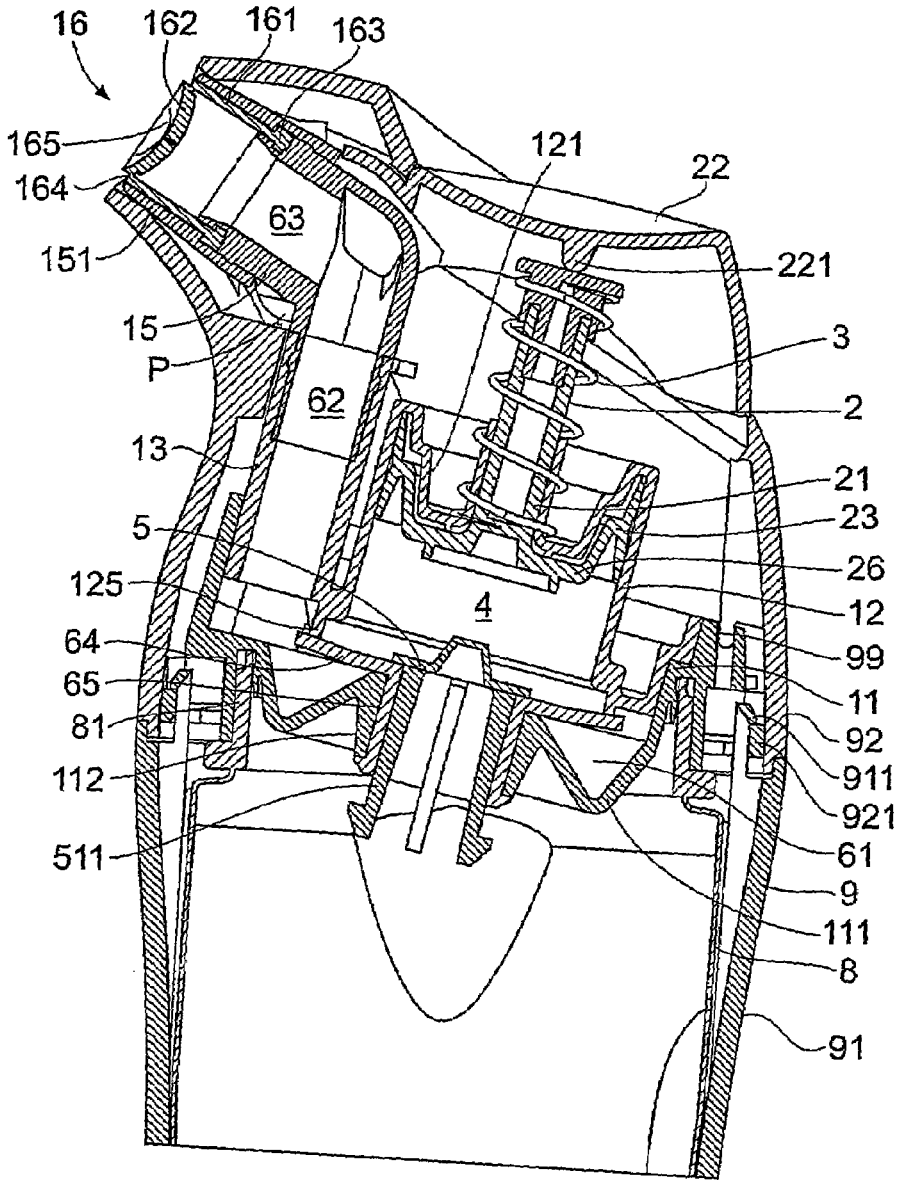
FIG. 1 is an axial cross-section through the upper part of a toothpaste dispenser.
Figure 2:
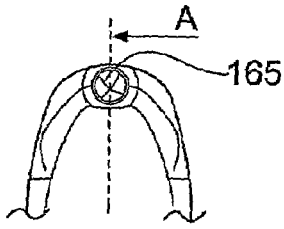
FIG. 2 is a front view of that part of the dispenser.

FIG. 1 is a section on line A seen in FIG. 2. The major elements of the dispenser include

- a collapsible polymeric bag container 8 for containing toothpaste;
- a pump base component 11 into which the top of the bag 8 is plugged, and having an inlet 112;
- a pump cylinder body 12 plugging into the top of the pump base 11 to define a pump chamber 4;
- a pump plunger 2 having a stem 21 and a piston 23 working in the cylinder 12;
- a discharge channel 13,15 extending up alongside the cylinder 12 to a transversely-directed outlet with a special elastomeric closure 16;
- a pivotable plunger cap 22 for operating the plunger 2, and
- an outer container shell 9 with upper and lower parts 92,91 which snap together to surround the bag 8, provide a stable support base and to locate the above-mentioned components relative to one another while exposing the pivotable plunger button 22.

A skilled person will readily understand the general operation of the pump dispenser from the drawings. The plunger button 22, pivoted at P, bears on the top of the plunger stem 21 via a contact pad 221 forwardly of the rear of the cap, so that pressing on the rear of the cap 22 gets a modest mechanical advantage. The plunger 2 descends against the action of a return spring 3 external to the pump chamber 4. The piston is retained in the chamber by an inturned top portion 121 of the cylinder body 12.

The pump base 11 has a generally cylindrical surround wall into which the cylinder body 12 is a snap-fit, with the cylinder itself slightly offset to the rear. The pump base 11 has an annular trough 111 around the inlet 112, defining an annular discharge space 61. To the front of the pump, this discharge space 61 communicates up into an upward tubular extension 13 of the pump body unit, connected in turn to an elbow tube 15 and a snapped-on end adaptor 151, defining between them a riser portion 62 and a nozzle portion 63 of the pump's discharge channel.

The cylinder 12 is mounted in the body casing with its plunger axis tilted slightly rearwardly at the top to make best use of the casing space above the container 8. Its lower end is open and has a circular downwardly-directed edge 125. This acts as a seat for the circular, radial flap 64 of an elastomeric outlet valve piece, whose centre is anchored in the base plate 11 by a tubular part 65 plugging through the base plate inlet opening 112. This radial flap 64 separates the pump chamber 4 from the annular discharge space 61.

An inlet valve body 5 has a top blocking plate dimensioned to lie sealingly over the top of the inlet bore, anchored by toothed springy legs 511 extending through the bore so that the valve body 5 can slide up to a limited extent to open the inlet. In this construction the inlet valve body 5 seals against an upper elastomer surface of the outlet valve body.

Adjacent the discharge nozzle, the discharge passage construction (mostly enclosed in the top casing 92) has a rubber closure valve 16 to protect toothpaste in the passage from the outside air, and to assist with a clean cut off of toothpaste dispensed. This valve is a single moulded rubber entity, preferably of silicone rubber, and has an outwardly-concave circular front wall 162 closing off the front opening of the discharge nozzle, held in place in the assembly by an integral cylindrical mounting sleeve 161 with a rear bead 163 trapped between the elbow 15 and adaptor 151 of the discharge channel. A thinner linking portion 164 joins the thicker body of the concave front wall 162 to the connecting sleeve 161. A discharge orifice in the front wall is provided by a set of radial through-slits 165 (see also FIG. 2), in this case a crossed pair of straight slits. Closures of this general type are in themselves known and are commercially available, as the skilled person will know, typically for use on squeeze containers. They have a characteristic "snap" operation, remaining closed until a threshold outward pressure is reached sufficient to force the concave wall 162 through its highest-energy compressed condition to a position in which the "petals" between the slits 165 can bend forward and open the nozzle. When the pressure is relaxed the elastic restoration of the wall 162 to its concave rest condition first closes the slits 165 and then retracts them as the wall returns, helping to break away from the dispensed material.

Thus, in operation of the pump (assuming that the pump chamber 4 is already primed through a previous use) a user presses the rear of the plunger button 22 which swings down (around pivot P) to force the piston 23 down in the cylinder 12, expelling toothpaste from the pump chamber 4 through the large annular area available at the discharge valve flap 64. By way of the discharge chamber 61, dispensed material passes up the discharge passage 62,63 and out through the slitted closure 16 in the manner described above. At the end of each dispensing stroke, as the plunger bottoms and starts to rise again pushed by the spring 3, the outward pressure abruptly stops and is followed by a back-pressure as the plunger rises; this of course lifts the inlet valve 5 to refill the pump chamber 4.

Also at this moment of pressure drop the slitted elastomeric closure 16 retracts. Being closed during its retraction, it must retract against the resistance of the body of toothpaste in the discharge channel 63 behind it. The large area of the elastomeric discharge valve flap 64 is also closing with an appreciable delay, and because of its large area permits an appreciable back-flow of material into the pump chamber 4 before the flap 64 meets the seat edge 125 and prevents all further flow save through the inlet valve 5. This reverse flow action at the discharge valve facilitates a proper positive retraction of the slitted closure 16 at the nozzle outlet.

The cooperation between the closure valve 16 and the discharge valve of the pump chamber can be "tuned" in dependence on the dimensions and properties of the nozzle closure by adjusting correspondingly the dimensions and properties of the pump discharge valve member. This can be achieved by testing.

Figure 3:
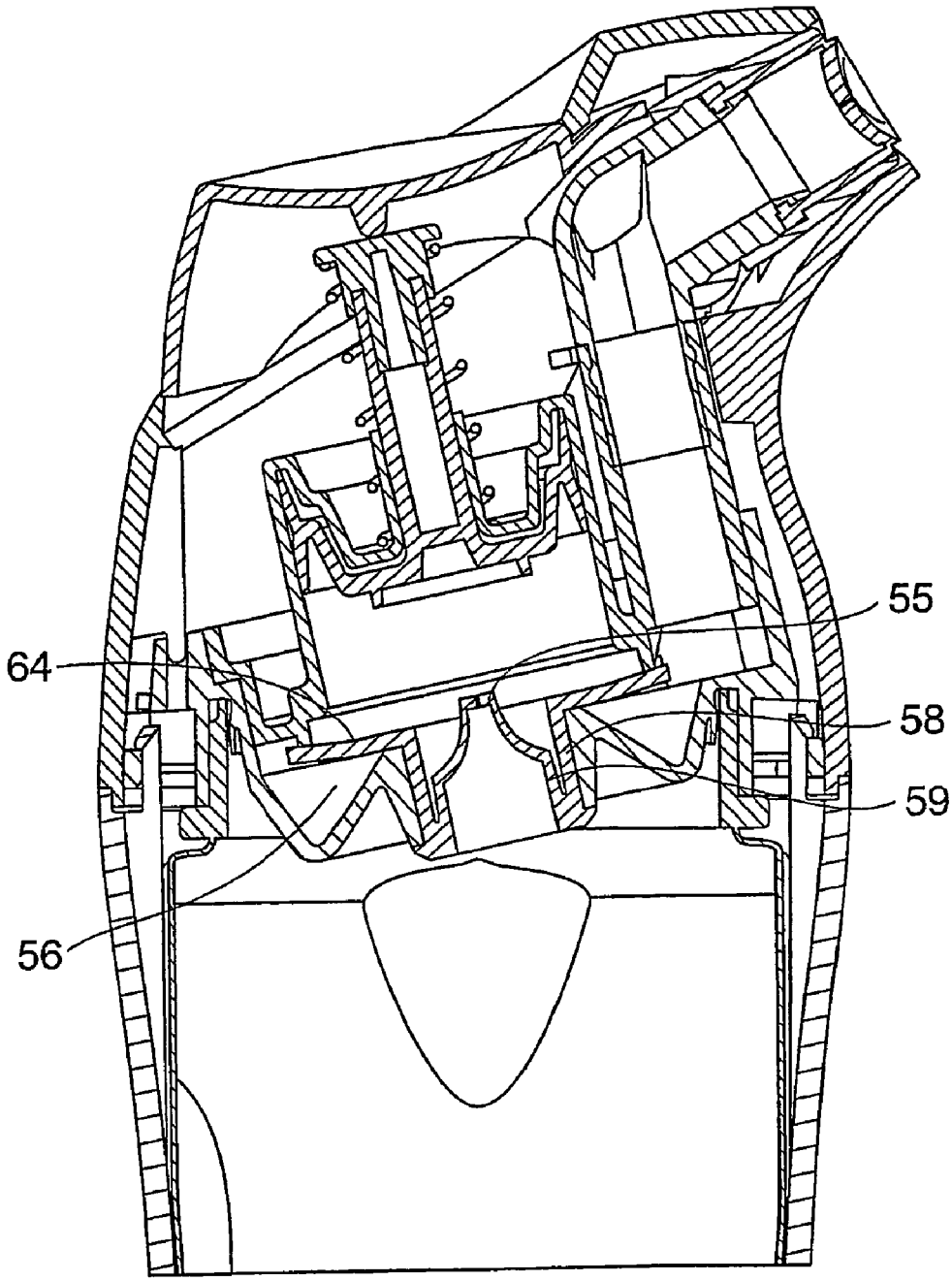
FIG. 3 is an axial cross-section of the upper part of a second toothpaste dispenser showing a modified valve module.
Figure 4:
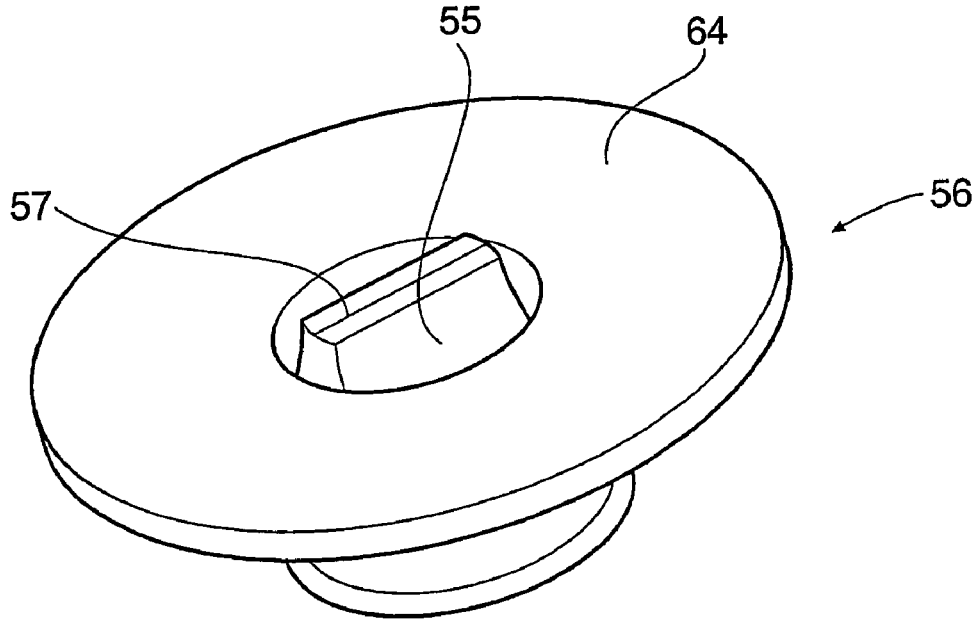
FIG. 4 and FIG. 5 are respectively top and bottom oblique views of a one-piece valve module from a FIG. 3 pump.
Figure 5:
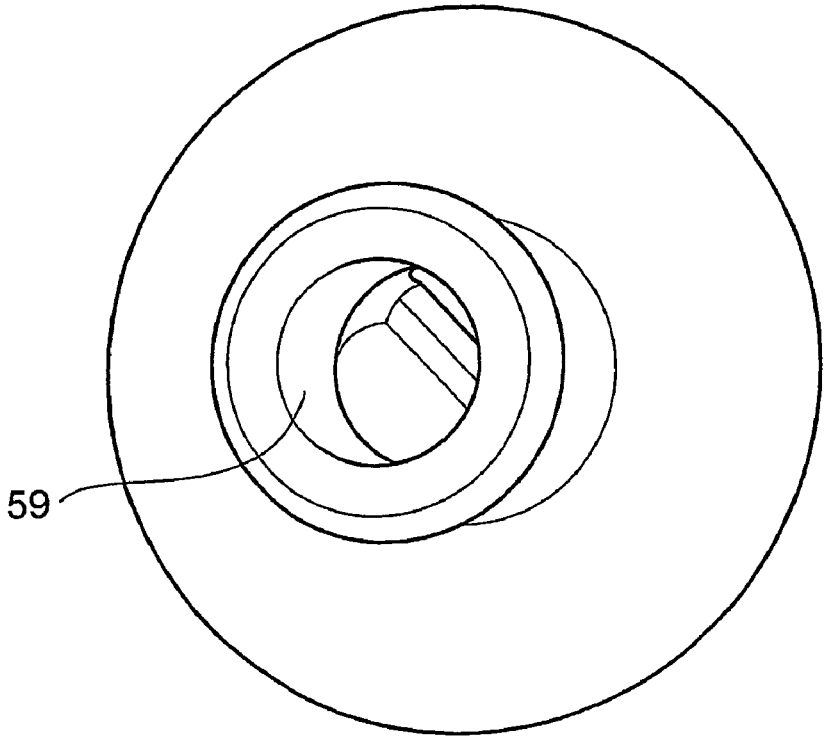
Figure 6:
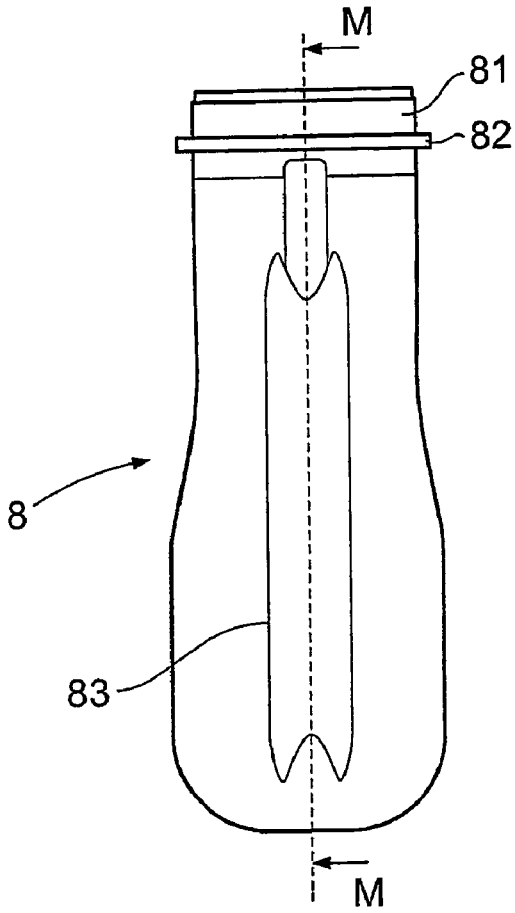
FIGS. 6 to 9 are first and second side elevations, a top view and a section at O-O (see FIG. 7) of a collapsible bottle or container for holding paste to be dispensed.
Figure 7:
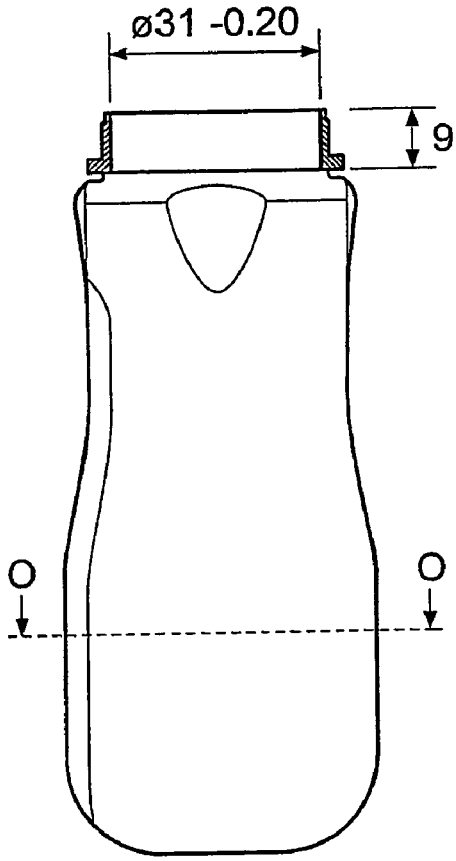
Figure 8:
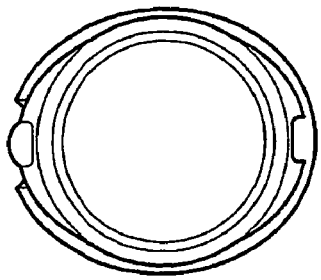

FIGS. 3 to 5 describe a variant construction of the pump chamber valves. Here the inlet valve and outlet valve are provided by a one-piece elastomeric component 56 having a circular radial flap 64 as before, a tubular central plug 58 as before, to anchor it down into the inlet hole 112 of the pump base 11, doubling back to form an internal tube 59 open to the container interior at its bottom, and terminating in a duckbill valve 55 at the top. A duckbill valve provides a resilient non-return function in a single component, by means of a slit 57 at its tip. Use of a duckbill valve as the inlet valve to a dispenser pump is not conventional, particularly when combined in one piece with an outlet valve in the manner described.

FIGS. 1 and 3 also show how the lower part 91 of the outer casing 9 is generally coextensive with the bag container 8 so as to support and contain it for assembly. The lower periphery of the upper casing part 92 has an internal securing ring 921, and sprung teeth 911 of the lower part snap behind this ring 921 to hold the dispenser casing together on assembly. The casing also makes a locating engagement 99 with a rear extension of the pump base 11, to assure the rotational alignment of this base.

The flexible bag container which contains the toothpaste has a special construction and this is shown in more detail in FIGS. 6 to 9.

Figure 9:
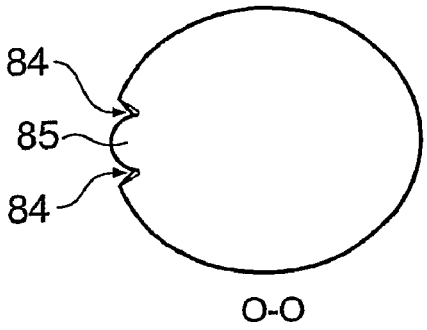

Firstly, as mentioned, it has a thickened top neck 81 and locating flange 82 to fix and locate it in and relative to the pump base 11. The lower, collapsible part of the bag may feature a gradual decrease in wall thickness from the top to the bottom of the bag, to promote collapse of the bag from the bottom upwards as product is gradually dispensed. This is a first measure to reduce the chance of a body of product becoming trapped at the bottom of the bag as the upper regions collapse. A second feature shown here, which may be an addition or an alternative to the graduated wall thickness, is a corrugated formation 83 extending down one side of the bag, for most of the length of the collapsible part. As shown in FIG. 9, this corrugation provides rib projections 84 running side by side up the bag with a recess 85 between. As the bag collapses, the rib projections 84 tend to keep the clearance 85 open as a communication channel, reducing the possibility of bodies of product becoming isolated from the pump intake.

The invention claimed is:

1. A dispenser pump having a pump body and a plunger reciprocable relative to the pump body by hand in a pumping stroke, thereby altering the volume of a pump chamber defined between the pump body and plunger, the pump chamber having a base, an inlet at said base to admit flowable material from a container to which the pump is secured and an outlet at said base to a fixed discharge passage, the discharge passage leading up beside the pump chamber to a fixed discharge nozzle having an external opening, wherein the discharge nozzle opening has a closure valve comprising a wall of resiliently flexible material whose periphery is constrained at the adjacent discharge nozzle structure, which wall is outwardly concave in its rest condition and which has plural radiating slits constituting said discharge opening, which slits are closed in said outwardly concave rest condition of the wall but open when the wall bulges outwardly under pressure of flowable material discharged from the pump chamber through the discharge passage;

wherein a pump outlet valve is provided between the pump chamber and the discharge nozzle opening, the pump outlet valve being a flap valve and the discharge flow area at the pump outlet valve being greater than the discharge flow area at the discharge nozzle immediately upstream of said closure valve, whereby at the end of a discharge of said flowable material in said pumping stroke, on resilient retraction of said closure valve wall to its rest condition there is a reverse flow of the flowable material back along the discharge passage, and return movement of said flap valve to a closed condition thereof accommodates said reverse flow;

the pump outlet valve flap being an annular flap leading from the pump chamber into an annular outlet chamber which is a first part of the discharge passage;

wherein the annular outlet valve flap surrounds the pump chamber inlet;

wherein an inlet valve for the pump chamber inlet is a duckbill valve, the duckbill valve having a tip with a slit that faces the pump chamber; and wherein the duckbill inlet valve is formed in one piece with the outlet valve flap.

2. A dispenser pump according to claim 1 in which the pump outlet valve flap is resiliently flexible.

3. A dispenser pump according to claim 1 connected to a said container which is either a collapsible bag or has a follower piston, so that the volume of the container reduces as material is dispensed from it.

4. A toothpaste dispenser incorporating a dispenser pump according to claim 1.

5. A dispenser pump having a pump body and a plunger reciprocable relative to the pump body by hand in a pumping stroke, thereby altering the volume of a pump chamber defined between the pump body and plunger, the pump chamber having a base, an inlet at said base to admit flowable material from a container to which the pump is secured and an outlet at said base to a fixed discharge passage leading to a fixed discharge nozzle having an external opening, wherein:

the discharge nozzle opening has a closure valve comprising a wall of resiliently flexible material whose periphery is constrained at the adjacent discharge nozzle structure, and which has one or more slit discharge openings which are closed in an outwardly concave rest condition of the wall but open when the wall bulges outwardly under pressure of flowable material discharged from the pump chamber through the discharge passage;

a pump outlet valve with a resiliently flexible annular flap is provided between the pump chamber and the discharge nozzle opening having said closure valve, and the pump outlet valve leading from the pump chamber down into an annular outlet chamber which surrounds the pump chamber inlet and constitutes a first part of the discharge passage, the discharge flow area at the pump outlet valve is greater than the discharge flow area at the discharge nozzle immediately upstream of the closure valve, to accommodate reverse flow of said material in the discharge passage at the end of a said pumping stroke when said closure valve wall retracts to its outwardly concave rest position wherein the annular flap of the pump outlet valve surrounds the pump chamber inlet;

wherein an inlet valve for the pump chamber inlet is a duckbill valve, the duckbill valve having a tip with a slit that faces the pump chamber; and wherein the duckbill inlet valve is formed in one piece with the annular flap of the outlet valve.

6. A dispenser pump according to claim 5 connected to a said container which is either a collapsible bag or has a follower piston, so that the volume of the container reduces as material is dispensed from it.

7. A toothpaste dispenser incorporating a dispenser pump according to claim 5.

8. A dispenser according to claim 6, wherein the container is the collapsible bag.

9. A dispenser according to claim 8, wherein the collapsible bag has a gradual decrease in wall thickness from top to bottom of the collapsible bag.

10. A dispenser according to claim 8, further comprising:

the collapsible bag including a corrugated formation extending along one side of the collapsible bag; and the corrugated formation defining a rib projection with a recess for reducing the chance of the flowable material being isolated from the pump chamber inlet.

11. A dispenser according to claim 3, wherein the container is the collapsible bag.

12. A dispenser according to claim 11, wherein the collapsible bag has a gradual decrease in wall thickness from top to bottom of the collapsible bag.

13. A dispenser according to claim 11, further comprising:

the collapsible bag including a corrugated formation extending along one side of the collapsible bag; and the corrugated formation defining a rib projection with a recess for reducing the chance of the flowable material being isolated from the pump chamber inlet.

* * * * *